US011369859B2

(12) United States Patent
Galli

(10) Patent No.: US 11,369,859 B2
(45) Date of Patent: Jun. 28, 2022

(54) METHOD AND SYSTEM FOR THE CONTINUOUS RANKING OF COMPETITORS DURING A RACE OF A SLALOM SKIING SPORTS DISCIPLINE

(71) Applicant: Swiss Timing Ltd, Corgemont (CH)

(72) Inventor: Reto Galli, Muenchenbuchsee (CH)

(73) Assignee: Swiss Timing Ltd, Corgemont (CH)

( * ) Notice: Subject to any disclaimer, the term of this patent is extended or adjusted under 35 U.S.C. 154(b) by 207 days.

(21) Appl. No.: 16/547,918

(22) Filed: Aug. 22, 2019

(65) Prior Publication Data

US 2020/0061442 A1 Feb. 27, 2020

(30) Foreign Application Priority Data

Aug. 22, 2018 (EP) ..... 18190315

(51) Int. Cl.
*A63C 11/00* (2006.01)
*A63K 3/00* (2006.01)
(Continued)

(52) U.S. Cl.
CPC ..... *A63C 11/003* (2013.01); *A63B 71/02* (2013.01); *A63B 71/0669* (2013.01); *A63K 3/00* (2013.01); *A63C 2203/22* (2013.01)

(58) Field of Classification Search
CPC ..... A63B 2220/62
See application file for complete search history.

(56) References Cited

U.S. PATENT DOCUMENTS 6,033,227 A * 3/2000 Ishige ..... A63B 69/18 434/253
6,539,336 B1 * 3/2003 Vock ..... A42B 3/0433 702/178

(Continued)

FOREIGN PATENT DOCUMENTS

CH 707 401 A2 6/2014
CN 103212197 A 7/2013

(Continued)

OTHER PUBLICATIONS

European Search Report dated Jan. 31, 2019 in European Application 18190315.4 filed on Aug. 22, 2018 (with English Translation of Categories of Cited Documents & Written Opinion).

(Continued)

*Primary Examiner* — James S. McClellan
*Assistant Examiner* — Peter J Iannuzzi
(74) *Attorney, Agent, or Firm* — Oblon, McClelland, Maier & Neustadt, L.L.P.

(57) ABSTRACT

A method for the continuous ranking of a competitor during a race of a slalom skiing type sports discipline includes the following iterative steps: a step of measuring the variation in the lateral angle of the gliding board about a predefined axis, a step of detecting the moment when the angle passes through a predefined value, a step of recording the competitor's run time corresponding to the detected moment, a step of comparing the stored run time with those of the preceding competitors for the corresponding detected moment, and a step of ranking the competitor with respect to the preceding competitors as a function of the run time of each competitor. A ranking system implements the method.

20 Claims, 3 Drawing Sheets

(51) Int. Cl.
*A63B 71/02* (2006.01)
*A63B 71/06* (2006.01)

(56) References Cited

U.S. PATENT DOCUMENTS

| | | | | |
|---|---|---|---|---|
| 8,616,979 | B1 | 12/2013 | Daniel | |
| 2007/0061106 | A1* | 3/2007 | Vock | G01C 9/00 702/182 |
| 2014/0257568 | A1 | 9/2014 | Czaja et al. | |

FOREIGN PATENT DOCUMENTS

| | | | |
|---|---|---|---|
| CN | 206121120 | U | 4/2017 |
| CN | 103959094 | B | 5/2018 |
| CN | 108379809 | A | 8/2018 |
| EP | 1 406 066 | A2 | 4/2004 |
| EP | 3 292 894 | A1 | 3/2018 |
| JP | 2005-160533 | | 6/2005 |
| KR | 10-2017-0105335 | A | 9/2017 |

OTHER PUBLICATIONS

Combined Chinese Office Action and Search Report dated Aug. 24, 2020 in Patent Application No. 201910771104.5 (English translation of Category of Cited Documents), 7 pages.

* cited by examiner

METHOD AND SYSTEM FOR THE CONTINUOUS RANKING OF COMPETITORS DURING A RACE OF A SLALOM SKIING SPORTS DISCIPLINE

CROSS-REFERENCE TO RELATED APPLICATION

This application claims priority to European Patent Application No. 18190315.4 filed on Aug. 22, 2018, the entire disclosure of which is hereby incorporated herein by reference.

FIELD OF THE INVENTION

The invention concerns a method for the continuous ranking of competitors during a race of a slalom skiing type sports discipline, wherein the competitor is provided with at least one gliding board, such as skis or a snowboard.

The invention also concerns a continuous ranking system for implementing the method.

BACKGROUND OF THE INVENTION

In a ski or board sports competition, such as a slalom or giant slalom ski race, which may have one or more runs, the race is made more appealing to spectators or television viewers by displaying the intermediates times of the competitor on the piste, in order to rank his or her current position relative to the preceding competitors. The intermediate times are, for example, measured by means of a light gate between two photoelectric cells, which are placed a few metres apart from each other, and which activate the instantaneous recording of the timer value when the competitor crosses the gate. However, the terrain configuration and the risk of untimely activation by members of the organisation restrict its use on the piste.

Another method consists in manually activating the recording of the timer value as the competitor passes, but the accuracy and reliability are not high enough.

To determine the exact time of passage of competitors, there exists a method and a system disclosed in Patent No. WO2016174612, in which magnets are placed along the course, preferably on each gate. The magnets are detected by a magnetometer worn by the competitor, and the data is transmitted so that the time of passage of the competitor at each gate is known. However, implementation is long, since each magnet has to be placed in the snow, which is all the more inconvenient when the course is changed between two runs. Further, the range of the magnets is not always sufficient when a competitor passes at a greater distance from the gate.

In another Patent (WO2010119084), accelerometers are arranged in the slalom gates or poles, to detect passage of the competitor. However, such a device cannot identify the gates in order to differentiate between them, and also does not facilitate replacement of a gate during a race.

It is also to be noted that it is possible to envisage continuously measuring speed by using a receiver of a satellite tracking system of the GPS/GNSS type. Depending on interference due to multiple signal paths, to the sky being blocked by mountains or other objects and to geometric dilution of accuracy, an accuracy of 95% can nonetheless be achieved. On a mountain slope with an inclination of 45°, horizontal speed is 30% lower than three-dimensional speed. In order to work accurately on a racing skier, the GPS receiver must be placed on the skier's helmet, but this represents an unacceptable safety risk during a race. Further, as the sensor is not attached to the ski, there is a lack of precision due to movements between the head and the ski. Although GPS technology normally permits speed measurement in three directions, the user of the GPS device only receives two-dimensional speed horizontally. This may result in a big difference for the skier compared to his actual speed, which is a drawback.

SUMMARY OF THE INVENTION

It is thus an object of the invention to overcome the drawbacks of the aforementioned state of the art by proposing a method for the continuous ranking of competitors during a race of a slalom skiing sports discipline, the competitor being provided with at least one gliding board, such as skis or a snowboard, wherein it is possible to rank the competitor with respect to the preceding competitors and regularly update the ranking throughout the race.

To this end, the invention concerns a method for the continuous ranking of competitors during a race of a slalom skiing sports discipline, wherein the competitor is provided with at least one gliding board, such as skis or a snowboard.

The method is remarkable in that it includes the following iterative steps:

- a step of measuring the variation in the lateral angle of the gliding board about a predefined axis,
- a step of detecting the moment when the angle passes through a predefined value,
- a step of recording the competitor's run time corresponding to the detected moment,
- a step of comparing the stored run time with those of the preceding competitors for the corresponding detected moment, and
- a step of ranking the competitor with respect to the preceding competitors as a function of the run time of each competitor.

Thus, only one parameter is monitored—the lateral orientation of the gliding board, for example a ski or snowboard—to determine the moments when the competitor changes position between two slalom turns. The changes in lateral orientation generally occur between the obstacles that competitors have to zigzag around, for example gates or poles.

Whatever the trajectories of the competitor, the changes in orientation generally occur at the same level of the ski slope between the gates. Consequently, by detecting the moments at which they occur, it is possible to follow the progress of the competitor throughout the slalom and to determine the run times of the competitors between each change in orientation. Thus, run times are recorded progressively throughout the slalom, each recorded time corresponding to a change in orientation of the skis.

The recorded run time is compared to the run times recorded for the preceding competitors for a corresponding detected moment. Thus, the competitor performing the slalom can be ranked with respect to the preceding competitors at that moment. The place that the competitor occupies at that moment in the race is known.

At each new detected moment, the ranking of the competitor is re-evaluated by means of this method. The ranking of the competitor is thus updated very frequently, virtually between each obstacle of the slalom.

As a result of this method, it is sufficient to monitor a single parameter—the angle of lateral rotation of the ski with respect to the plane of the slalom piste—to determine the run time to be recorded and to compare it to the preceding competitors. This is thus a reliable method that is technically simple to implement, which frequently updates the ranking of the competitor and follows the changes of the competitor's position in the ranking throughout the race.

Further, the method does not require any complex equipment on the course or on the slalom obstacles. Further, no external factor is used and relied upon, such as a satellite system, for example.

According to a particular embodiment of the invention, in the measuring step, the predefined axis is chosen to be oriented substantially along the longitudinal axis of the gliding board, the lateral angle being measured with respect to the plane of the slope of the course.

According to a particular embodiment of the invention, in the detection step, the value of the predefined angle is chosen to be zero, the gliding board being substantially parallel to the plane of the piste.

According to a particular embodiment of the invention, in the detection step, the sign of the angle value is detected.

According to a particular embodiment of the invention, in the detection step, moments are detected for two angle values, a first type of moment when the angle value changes from a value less than a value greater than or equal to a first predefined value, and a second type of moment when the angle changes from a greater value to a value less than or equal to a second predefined value.

According to a particular embodiment of the invention, in the recording step, the first types of moment are associated with a turn in a first direction, substantially orthogonal to the predefined axis, and the second types of moment are associated with a turn in the opposite direction to the first turn, for example right and left.

According to a particular embodiment of the invention, the first predefined value is comprised in a range of 3° to 30°, preferably of 5° to 15°, for example 10°, and the second predefined value is comprised in a range of −30° to −3°, preferably of −15° to −5°, for example −10°.

According to a particular embodiment of the invention, in the comparison step, a mean run time is computed over a series of consecutive detected moments, for example over the last four detected moments.

According to a particular embodiment of the invention, in the ranking step, the competitor is ranked with respect to the preceding competitors as a function of the mean run time.

According to a particular embodiment of the invention, the ranking step is performed after a predefined number of detected moments, for example after the fourth detected moment.

According to a particular embodiment of the invention, the method includes an additional step of transmitting the recorded time, between the detection step and the recording step.

According to a particular embodiment of the invention, the method includes an additional step of displaying the competitor's ranking for the detected moment.

According to a particular embodiment of the invention, in the display step, the competitor's run time for the detected moment is also displayed.

The invention concerns a method for the continuous ranking of competitors during a race of a slalom skiing type sports discipline, the competitor being provided with at least one gliding board, such as skis or a snowboard, for implementation of the continuous ranking method described above.

To this end, the system includes:

- a measurement unit for measuring the variation in the lateral angle of the gliding board about a predefined axis, for example an inertial measurement unit provided with a gyroscope.
- a detection unit configured to detect the moment when the angle passes through a predefined value,
- a device for measuring the run time of the competitors,
- a processing unit configured to record the competitor's run time when it receives a detection signal, to compare it with those of the preceding competitors for the corresponding detected moment, and to rank the competitor with respect to the preceding competitors as a function of the run time of each competitor.

According to a particular embodiment of the invention, the system includes a portable transponder module provided with the measurement unit, the detection unit and a transmitter for transmitting the detection signal to the processing unit.

According to a particular embodiment of the invention, the transponder module is arranged on the competitor's ski boot.

According to a particular embodiment of the invention, the system includes a ranking display unit.

BRIEF DESCRIPTION OF THE DRAWINGS

The objects, advantages and features of the ranking method and system according to the invention will appear more clearly in the following description of at least one non-limiting embodiment illustrated by the drawings, in which.

DETAILED DESCRIPTION OF THE INVENTION

According to the invention, the method is arranged to allow the continuous ranking of a competitor with respect to the preceding competitors during a race of a slalom ski type sports discipline. It concerns, for example, descending a slalom or giant slalom piste with skis or a snowboard. The invention can also be applied to any board sport which requires frequent turns to be made.

The term 'continuous' means that the ranking is regularly updated, and that it is frequently repeated during the competitor's run. The competitor is provided with at least one gliding board, such as skis or a snowboard, which allow him to glide over the piste, which is covered with snow.

Figure 1:
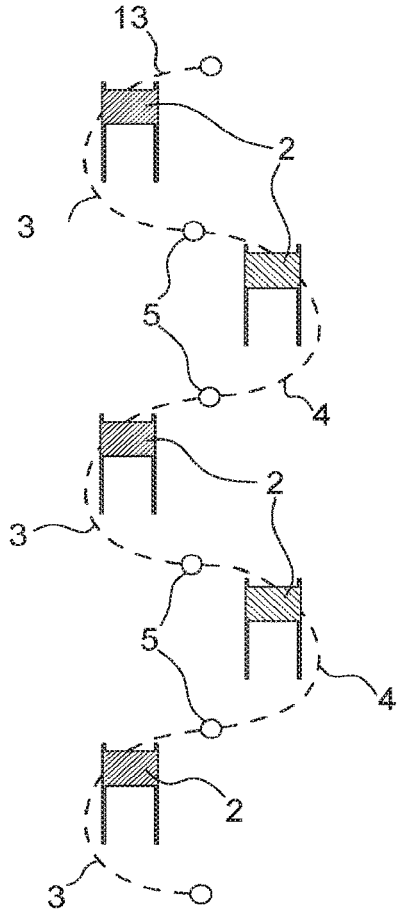
FIG. 1 is a schematic representation of a slalom ski course for which the method according to the invention is used.
Figure 1:
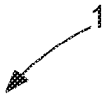

During a slalom race 13, as represented in FIG. 1, the competitor has to clear obstacles by making turns around them from a predefined side. The course 13 taken by the competitor is represented in dash lines in FIG. 1. The obstacles are, for example, slalom poles or gates 2 planted in the snow. Generally, the successive turns are oriented in opposite directions. For example, facing downhill on the piste, the competitor makes a left turn 3 to turn around a first gate 2 which he has to pass on the right side of the piste, and then a right turn 4 to turn around a second gate 2 which he has to pass on the left side. Thus, between two gates, the competitor has to suddenly change position to make a turn in the opposite direction. To achieve this, he has to change the lateral orientation of the skis on the piste to turn in the other direction. These changes are represented by small circles in FIG. 1.

Detecting the moment at which the competitor has changed the lateral position of the skis determines the points of passage 5 on course 13 for which run times are measured, which the competitor's ranking to be updated with respect to the preceding competitors, at each point of passage 5 on course 13.

Figure 2:
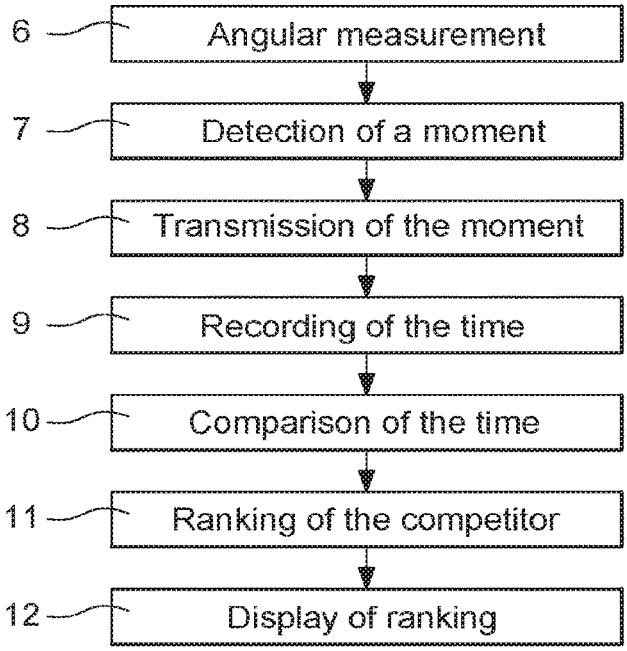
FIG. 2 is a synoptic diagram of a method for ranking a competitor according to the invention.

To this end, method 1, represented in FIG. 2, consists in a first step 6, of measuring the variation in the lateral angle of the gliding board about a predefined axis. Preferably, a predefined axis oriented substantially along the longitudinal axis of the gliding board is chosen. When the board is flat on the piste the angle is zero, and when the board is raised on one side or the other, it forms a positive angle on one side and a negative angle on the other with the piste position. Thus, the angle that the gliding board forms with the piste is measured on the predefined axis.

In a second step 7, the moment at which the angle passes through a predefined value is measured.

According to a first embodiment of method 1, a zero angle value is chosen so that the gliding board is substantially parallel to the plane of the piste when this moment is detected. Thus, when the competitor changes the lateral orientation of his skis between two turns, he necessarily passes through a zero lateral angle value.

According to a second embodiment of method 1, the sign of the angle value is also detected to determine whether the angle has passed through a zero value. Moreover, it is possible to deduce the type of turn from the sign. For example, when the angle becomes negative, a left turn is detected, and when the angle becomes positive, a right turn is detected. Each detection can thus be associated with the orientation of the turn, be it left or right. By associating the type of turn with each detection, it is possible to track whether the competitor is following the same course as the other competitors.

According to a third embodiment of method 1, moments are detected for two angle values, a first type of moment when the angle value changes from a value less than a value greater than or equal to a first predefined value, and a second type of moment when the angle changes from a greater value to a value less than or equal to a second predefined value.

The first types of moment are associated with a turn in a first direction, substantially orthogonal to the predefined axis, and the second types of moment are associated with a turn in the opposite direction to the first turn. For example, a right turn is detected when the angle has a value greater than or equal to the first predefined value and a left turn when the angle has a value less than or equal to a second predefined value.

The first predefined value is comprised in a range of 3° to 30°, preferably of 5° to 15°, and the second predefined value is comprised in a range of −30° to −3°, preferably of −15° to −5°, to count all the turns. For example, an angle of 10° is chosen for the first value and −10° for the second value. In this example, a left turn is detected when the angle reaches −10°, even though it was greater than this value, and a right turn when the angle reaches 10° even though the angle was less than this angle.

In this third embodiment, there is a hysteresis effect in detection, to avoid detecting small turns that the competitor makes, for example, to right himself, and which is not due to avoiding a gate. In the last example, turns are not detected for values less than 10° and more than −10°.

In the example of FIG. 2, method 1 includes a third additional step 8 of transmitting the moment when the angle passes through a predefined value, between the detection step and the recording step. This step is optional and exists, for example, to provide the connection between a mobile detector such as a transponder, and a processing unit which performs the rest of method 1. For a mobile system which performs the entire method 1, there is no transmission step.

Method 1 include a fourth step 9 of recording the competitor's run time corresponding to the detected moment. The competitor's run time is timed from the start by the usual timing means. Thus, as soon as a moment is detected, the current run time is instantaneously recorded to be associated with the detected moment.

In the first embodiment, a run time is associated with each passage of the angle through the zero value.

In the second embodiment, a run time is associated with each change of sign of the angle value. Further, the direction of the turn—right or left—is known. It is thus possible to check whether the competitors have made the same number of left and right turns.

In the third embodiment, a run time is associated as soon as the angle is greater than or equal to the first predefined value, or as soon as the angle is less than or equal to the second predefined value. Further, the direction of the turn—left or right—is known, as in the second embodiment.

The next step is a step 10 of comparing the stored run time with those of the preceding competitors for the corresponding detected moment. Advantageously, the stored run times of the competitor are tallied and the last run time stored is compared with the stored run times of the preceding competitors of the same order.

According to a particular embodiment, during the comparison step, a mean run time is computed over a series of consecutive detected moments. To increase the ranking reliability, the mean value is, for example, computed over the last four detected moments. This thus avoid an erroneous ranking due to an anomaly in the course of the competitor Using the recorded run time, there is then a step 11 of ranking the competitor with respect to the preceding competitors as a function of the run time of each competitor. In the embodiment wherein a mean run time is computed over several moments, the competitor is ranked with respect to the preceding competitors as a function of the mean run time.

Advantageously, the ranking step is performed after a predefined number of detected moments, for example after the fourth detected moment. This therefore avoids creating a ranking over the first detected moments since there is a risk of error.

In FIG. 2, method 1 includes an optional additional step 12 of displaying the competitor's ranking for the detected moment. The ranking can thus be followed by spectators or television viewers who are watching the race. It is also possible to display the competitor's run time to monitor how far ahead or behind the competitor is compared to the preceding competitors.

The continuous ranking method 1 described above is implemented in an iterative manner throughout the competitor's run. Method 1 is repeated in the order of steps described above to update the ranking frequently, here at each turn change of the competitor.

Figure 3:
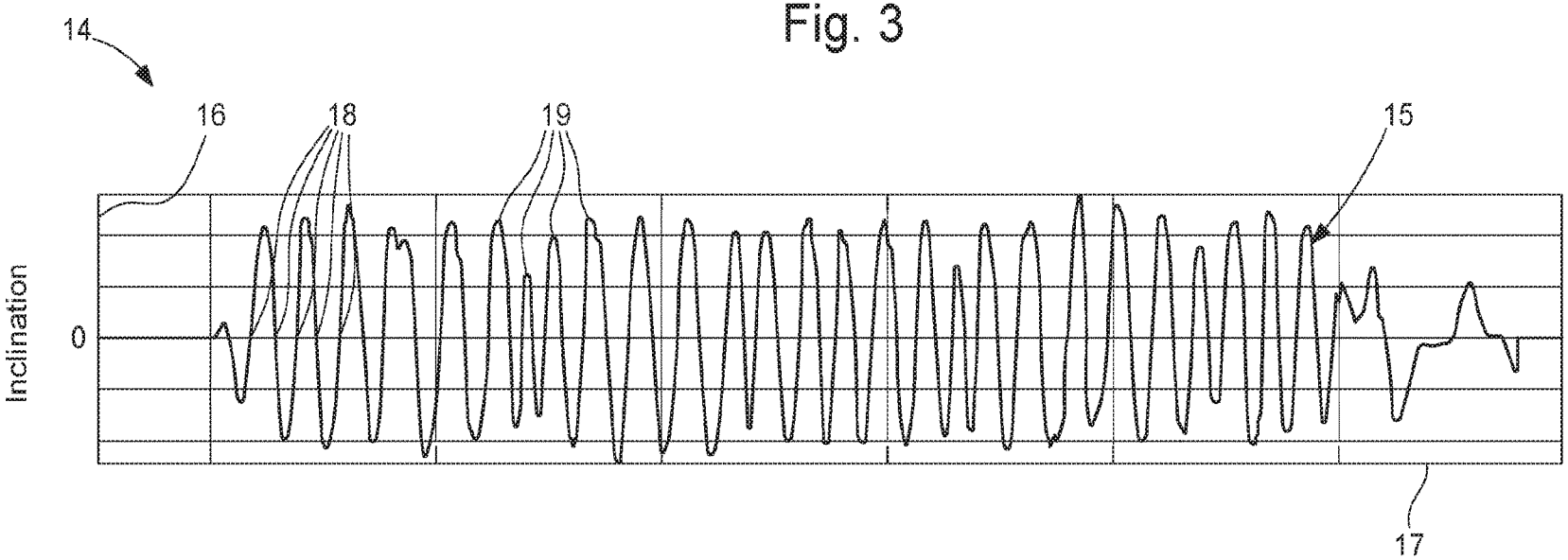
FIG. 3 is a graph representing the variations in the lateral angle of the gliding board during a slalom ski race.

In graph 14 of FIG. 3, function 15 represents the value of the angle of lateral rotation of the sliding board about the predefined axis on a slalom ski sports course. The value of angle 16 is on the ordinate, while the abscissa represents time 17. As soon as the angle passes through the zero value of angle 18, the competitor has turned in a different direction. Each peak 19 of the function corresponds to a gate that the competitor has turned around. Thus, by detecting the moments when the angle passes through the zero value, a run time between two gates is deduced.

Figure 4:
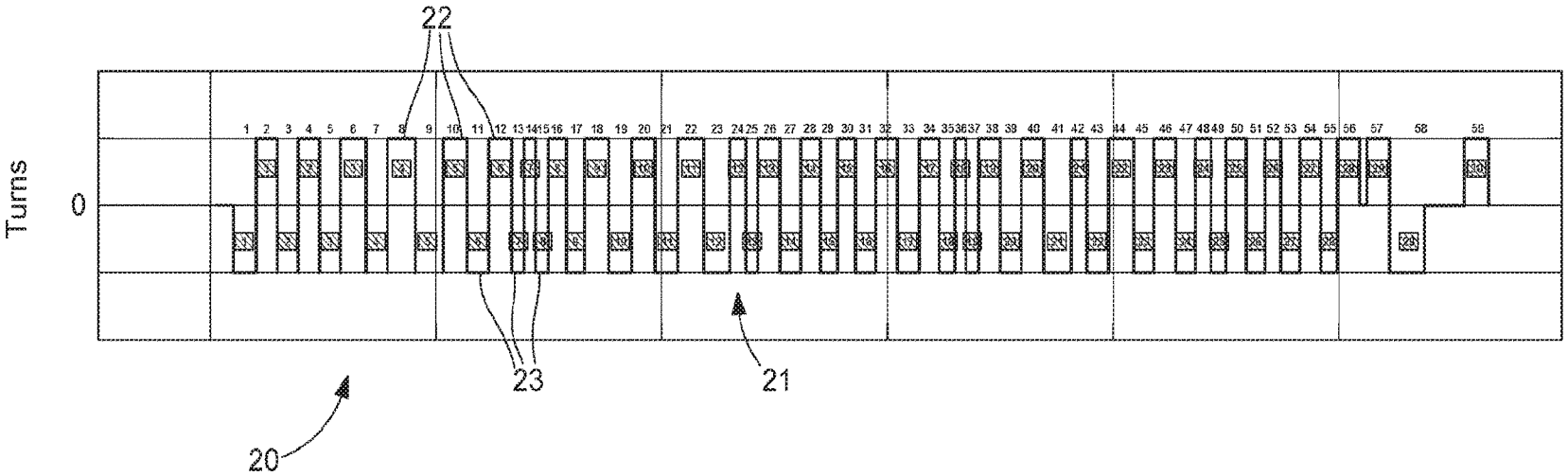
FIG. 4 is a graph representing the counting of the number of left and right turns performed with the method.

FIG. 4 shows the way in which the left or right turns are counted as a function of the sign of the angle seen in the graph of FIG. 3. Here, the sign of the angle is detected to deduce therefrom the nature of the turns. Function 21 has a rectangular profile, with positive rectangles 21 or negative rectangles 2 according to the sign of the angle, each rectangle representing a left or right turn. The positive value rectangles correspond, for example, to the right turns, and the negative value rectangles to the left turns. The competitor has thus made thirty right turns here and twenty-nine left turns, i.e. a final total of fifty-nine turns. The fifty-nine turns are counted above the rectangular curve, whereas the left and right turns are differentiated and inscribed directly on each corresponding rectangle.

Figure 5:
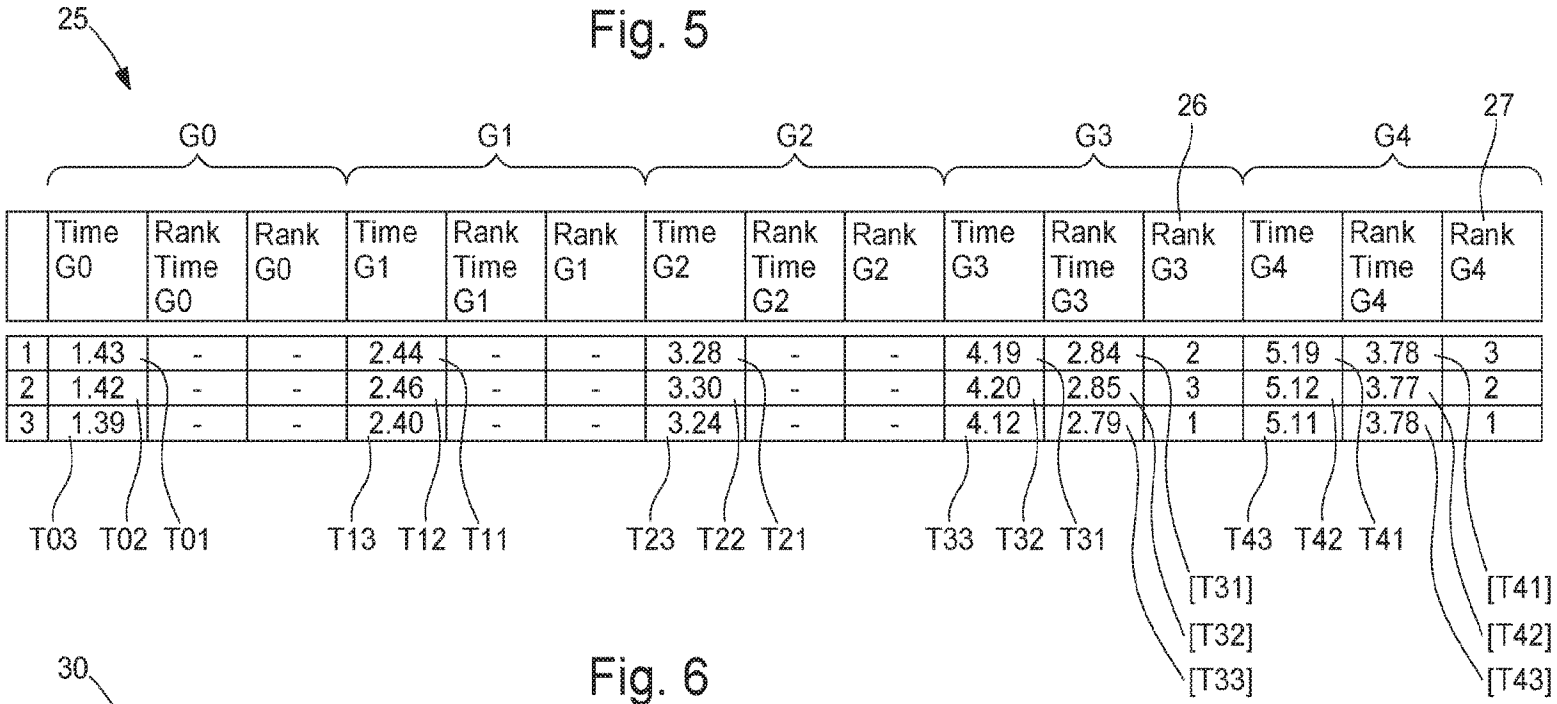
FIG. 5 is a table showing an example of the ranking obtained with the method of the invention.

An example ranking between several competitors, three in the example, is shown in Table 25 of FIG. 5, in which five moments G0, G1, G2, G3 and G4 have been detected and ranked corresponding to five turns made during a slalom race. Five times of passage T01, T02, T03, T11, T12, T1, T21, T22, T23, T31, T32, T33, T41, T42, T43, were thus recorded for each competitor at moments G0, G1, G2, G3 and G4. For the three times of passage G0, G1, G2, no ranking is performed, but a ranking 26, 27 is performed for the fourth and fifth run times at moments G4 and G5. Further, the Table corresponds to the embodiment wherein a mean run time is computed from the fourth detected moment, here for moments G3 and G4. The mean [Tij] is computed for a moment Gi, and for a competitor j, by the following equation:

$$[Tij] = \frac{Tij + T(i-1)j + T(i-2)j + T(i-3)j}{4}$$

Thus, from the computed means [T31], [T32], [T33], [T41], [T42], [T43], the competitors are ranked from the lowest mean to the highest mean for moments G3 and G4. For moment G3, the third competitor is the fastest, ahead of the first and second, while at detected moment G4, the second competitor is faster than the first, with the third still the slowest.

Figure 6:
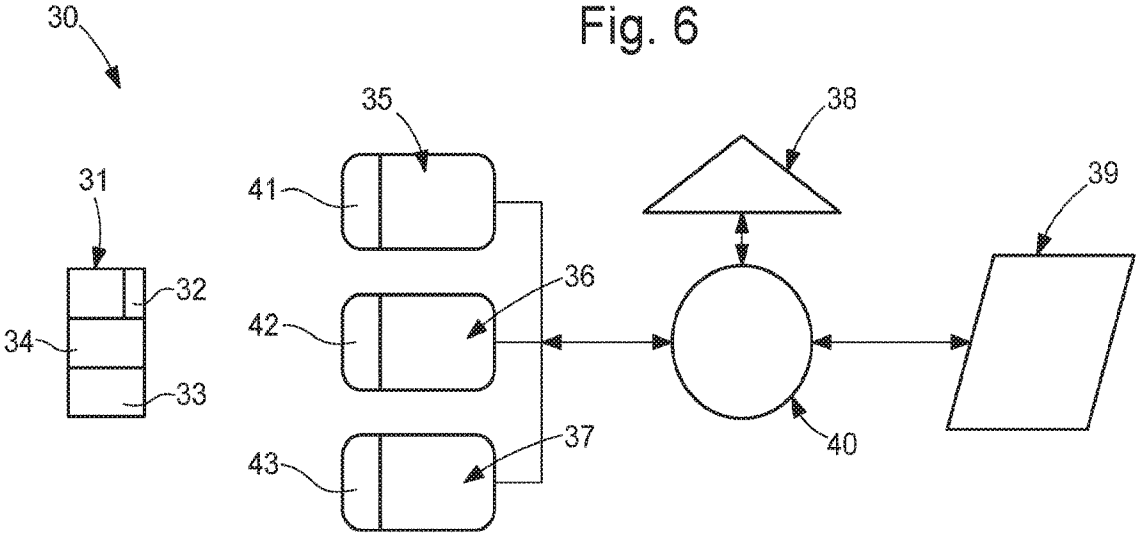
FIG. 6 is a schematic representation of a ranking system according to the invention.

The invention also relates to a system 30 for the continuous ranking of a competitor during a race of a slalom skiing sports discipline. System 30 is, in particular, suitable for implementing the method described above. FIG. 6 schematically represents the main elements, which compose ranking system 30 in a slalom type race, such as a ski or snowboard race. System 30 is arranged to rank the competitors in real time, i.e. live or continuously, while allowing live display of this ranking on a screen or by television broadcast on a television to spectators or television viewers.

System 30 includes one or more transponder modules 31, which are each intended to be worn by a competitor, who wears it to measure, in particular, the variation in lateral angle of the gliding board. Each transponder module 31 for the competition is disposed, for example, on one of the competitor's boots. Transponder module 31 includes a transmitter 32 provided with an antenna for transmitting a data signal, in particular a detection signal of a moment when the angle passes through the predefined value. For data signal transmission, the signal carrier frequency may be comprised between 300 MHz and 3,000 MHz, and especially, for example, at 433 MHz, 868 MHz or 915 MHz. Data modulation is achieved by amplitude modulation or frequency or phase modulation. It may be chosen from several carrier frequencies for transmission of the data signal. Thus, various transmission channels may be selected.

Each transponder module includes a measurement unit 33 for measuring the variation in the lateral angle of the gliding board about the predefined axis. Measurement unit 33 is, for example, an inertial measurement unit, which is a motion sensor generally formed of a 3-axis accelerometer, a 3-axis gyroscope and a 3-axis magnetometer. The gyroscope measures the angle variation about the predefined axis. It is to be noted that a sensor provided simply with a gyroscope is sufficient to measure the angular variation according to the method.

Transponder module 31 also includes a detection unit 34 configured to detect the moment when the measured angle passes through the predefined value or values, and the sign of the angle if necessary. Consequently, as soon as the angle value is detected, the module instantaneously transmits a detection signal.

System 30 also includes one or more base stations 35, 36, 37 which can each receive a signal transmitted by the antenna of transmitter 32 of the transponder module 31 in the race, particularly a detection signal of the moment when the competitor passes through the predefined value or values. Each base station 35, 36, 37 can receive the signal from transponder module 31, separately or together via a receiving antenna 41, 42, 43. It is to be noted that each base station 35, 36, 37 of the device can be placed at a specific location on the racing track. For example, in a ski or snowboard race, base stations 35, 36, 37 could be placed spaced apart from each other by 200 to 400 m between the start and finish of the course. Each base station 35, 36, 37 or at least one base station can receive a data signal from the transponder module 31 worn by the competitor during his run.

System 30 is also equipped with a timing device 38 and a display unit 39. Timing device 38 controls the timing of each competitor's run, and thus measures the run time of the competitors from the start until the competitor finishes. Display unit 39 displays the ranking in real time or continuously on at least one screen for spectators or television viewers via television broadcast devices or on the Internet.

System 30 further includes a processing unit 40 connected to the various base stations 35, 36, 37 and to timing device 38. The various base stations 35, 36, 37 can be connected by cable or also by wireless communication in order to transmit the signal to processing unit 40 by cable or also by wireless transmission. Processing unit 40 is configured to record the competitor's run time when it receives a detection signal from transmitter 32 of transponder module 31, transmitted by bases 35, 36, 37. Processing unit 40 stores the run time for the detected moment and compares the run time with those of the preceding competitors for the corresponding detected moment. Processing unit 40 then performs a ranking of the competitor with respect to the preceding competitors as a function of the run time of each competitor, according to any of the embodiments of the method described above. The ranking is simultaneously transmitted to display unit 39 for the spectators or television viewers.

The invention claimed is:

1. A method for continuous ranking of competitors during a race of a slalom skiing sports discipline along a racing track, a competitor being provided with at least one gliding board, the method comprises the following iterative steps:

measuring, by a sensor that includes a gyroscope and is arranged on a ski boot of the competitor, a variation in a lateral angle of the gliding board about a predefined axis;

detecting, by a detector, a moment when the lateral angle passes through a predefined value;

recording, by processing circuitry communicatively coupled to a plurality of base stations located along the racing track, a run time of the competitor corresponding to the detected moment;

comparing, by the processing circuitry that is communicatively coupled to the plurality of base stations located along the racing track, the recorded run time with run times of preceding competitors for the corresponding detected moment; and ranking, by the processing circuitry that is communicatively coupled to the plurality of base stations located along the racing track, the competitor with respect to the preceding competitors as a function of the run time of each competitor.

2. The method according to claim 1, wherein, in the measuring, the predefined axis is chosen to be oriented along a longitudinal axis of the gliding board, the lateral angle being measured with respect to a plane of a piste of a slalom course.

3. The method according to claim 2, wherein, in the detecting, the value of the predefined angle is chosen to be zero, the gliding board being parallel to the plane of the piste.

4. The method according to claim 3, wherein, in the detecting, a sign of the value of the angle is detected.

5. The method according to claim 1, wherein, in the detecting, moments are detected for two angle values, a first type of moment when the angle value changes from a value less than to a value greater than or equal to a first predefined value, and a second type of moment when the angle changes from a greater value to a value less than or equal to a second predefined value.

6. The method according to claim 5, wherein, in the recording, the first types of moment are associated with a turn in a first direction, orthogonal to the predefined axis, and the second types of moment are associated with a turn in an opposite direction to the first turn.

7. The method according to claim 5, wherein the first predefined value is comprised in a range of 3° to 30°, and the second predefined value is comprised in a range of −30° to −3°.

8. The method according to claim 5, wherein the first predefined value is comprised in a range of 5° to 15°, and the second predefined value is comprised in a range of −15° to −5°.

9. The method according to claim 1, wherein, in the comparing, a mean run time is computed over a series of consecutive detected moments over last four detected moments.

10. The method according to claim 9, wherein, in the ranking, the competitor is ranked with respect to the preceding competitors as a function of the mean run time.

11. The method according to claim 1, wherein, the ranking is performed after a predefined number of detected moments after a fourth detected moment.

12. The method according to claim 1, further comprising transmitting the recorded run time, between the detecting and the recording.

13. The method according to claim 1, further comprising displaying the ranking of the competitor for the detected moment.

14. The method according to claim 13, wherein, in the displaying, the run time of the competitor for the detected moment is also displayed.

15. A system for continuous ranking of competitors during a race of a slalom skiing sports discipline along a racing track, a competitor being provided with at least one gliding board, the system comprising:

a sensor that includes a gyroscope and is arranged on a ski boot of the competitor, configured to measure a variation in a lateral angle of the gliding board about a predefined axis;

a detector configured to detect a moment when the lateral angle passes through a predefined value;

a timer configured to time a run time of the competitor; and processing circuitry communicatively coupled to a plurality of base stations located along the racing track, the processing circuitry configured to record the run time of the competitor when the processing circuitry receives a detection signal, to compare the run time with run times of preceding competitors for the corresponding detected moment, and to rank the competitor with respect to the preceding competitors as a function of the run time of each competitor.

16. The system according to claim 15, wherein the sensor, the detector, and a transmitter configured to transmit the detection signal to the processing circuitry are included in a portable transponder.

17. The system according to claim 16, wherein the portable transponder, which includes the sensor, the detector, and the transmitter, is configured to be arranged on the ski boot of the competitor, and the processing circuitry is configured to transmit the detection signal to each of the plurality of base stations.

18. The system according to claim 15, further comprising a display to display the ranking.

19. A method for continuous ranking of competitors during a race of a slalom skiing sports discipline along a racing track, a competitor being provided with at least one gliding board, the method comprising:

receiving, by processing circuitry communicatively coupled to a plurality of base stations located along the racing track, a measurement of a variation in a lateral angle of the gliding board about a predefined axis, the measurement being measured by a sensor that includes a gyroscope and is arranged on a ski boot of the competitor;

receiving, by the processing circuitry that is communicatively coupled to the plurality of base stations located along the racing track, a detection of a moment when the lateral angle passes through a predefined value;

recording, by the processing circuitry that is communicatively coupled to the plurality of base stations located along the racing track, a run time of the competitor corresponding to the detected moment;

comparing, by the processing circuitry that is communicatively coupled to the plurality of base stations located along the racing track, the recorded run time with run times of preceding competitors for the corresponding detected moment; and ranking, by the processing circuitry that is communicatively coupled to the plurality of base stations located along the racing track, the competitor with respect to the preceding competitors as a function of the run time of each competitor.

20. The system according to claim 15, further comprising:

the plurality of base stations, which are spaced apart from each other by 200 to 400 m between a start and a finish of the racing track.

* * * * *